United States Patent [19]

Washizu et al.

[11] Patent Number: 4,962,009

[45] Date of Patent: Oct. 9, 1990

[54] MICROCAPSULE CONTAINING PHOTO-OXIDIZING AGENT AND LEUCO DYE

[75] Inventors: Shintaro Washizu; Jun Yamaguchi; Fumiaki Shinozaki; Akihiro Shimomura; Toshimasa Usami; Toshiaki Endo; Keiso Saeki, all of Fujinomiya, Japan

[73] Assignee: Fuji Photo Film Co., Ltd., Kanagawa, Japan

[21] Appl. No.: 257,580

[22] Filed: Oct. 14, 1988

[30] Foreign Application Priority Data

| | | | |
|---|---|---|---|
| Oct. 14, 1987 | [JP] | Japan | 62-259111 |
| Nov. 13, 1987 | [JP] | Japan | 62-287096 |
| Dec. 25, 1987 | [JP] | Japan | 62-329269 |
| Feb. 15, 1988 | [JP] | Japan | 63-32426 |
| Apr. 22, 1988 | [JP] | Japan | 63-99771 |

[51] Int. Cl.[5] ..... G03C 1/727; G03C 1/72; G03C 5/00

[52] U.S. Cl. ..... 430/138; 430/336; 430/337; 430/338; 503/205; 503/214

[58] Field of Search ..... 430/138, 337, 343, 344, 430/336, 338; 503/205, 214, 200

[56] References Cited

U.S. PATENT DOCUMENTS

| | | | |
|---|---|---|---|
| 3,390,995 | 7/1968 | Manos | 430/337 |
| 3,544,321 | 12/1970 | Yamada et al. | 430/337 |
| 3,708,297 | 1/1973 | Poot et al. | 430/337 |
| 4,060,416 | 11/1977 | Royen | 430/337 |
| 4,090,877 | 5/1988 | Streeper | 430/337 |
| 4,622,286 | 11/1986 | Sheets | 430/337 |

OTHER PUBLICATIONS

Srrague et al., "New Photographic Processes, 1. The Arylamine–Carbon Tetrabromide Systems Giving Print–Out Dye Images", *Photographic Science and Engineering,* vol. 5, pp. 98 to 103 (1961).

*Primary Examiner*—Richard L. Schilling
*Attorney, Agent, or Firm*—Sughrue, Mion, Zinn, Macpeak & Seas

[57] ABSTRACT

An image-forming material comprising: (a) microcapsules, in which at least one leuco dye capable of developing a color by oxidation and at least one photooxidizing agent (preferably a combination of a lophine dimer and an organic halogeno-compound) are enclosed together, and (b) at least one reducing agent not enclosed in the microcapsules (preferably present in the form of an emulsified dispersion), thereby achieving image formation in a completely dried condition, and ensuring excellent freshness keeping property, image reproducibility and fixability.

5 Claims, No Drawings

MICROCAPSULE CONTAINING PHOTO-OXIDIZING AGENT AND LEUCO DYE

FIELD OF THE INVENTION

The present invention relates to a novel image-forming material, and to a method of recording images using the material.

More particularly, the present invention relates to a novel image-forming material which can be used for various purposes, for example, as proof paper, print-out paper, overlay films, films for facsimile, printers, overhead projectors (abbreviated as OHP), computer-aided design (abbreviated as CAD), etc., and has high sensitivity, excellent freshness keeping property and high transparency.

BACKGROUND OF THE INVENTION

Image-forming materials of the above-described kind have so far been used as so-called "free radical photographs", the optically exposed areas of which are visualized by imagewise exposure, for many photographic purposes. On the other hand, heat sensitive recording has been performed for a long time according to various methods.

Materials particularly effective in forming light images are those utilizing radical coloration of various leuco dyes in tints of their corresponding dyes through the reaction with a photo-oxidizing agent (as described, e.g., in *Photo. Sci. Eng.*, vol. 5, pp. 98–103 (1961), JP-B-43-29407 (The term "JP-B" as used herein means an "examined Japanese patent publication"), and U.S. Pat. Nos. 4,271,251, 4.298,678 and 4,622 286).

As for the heat sensitive recording, heat-sensitive recording materials utilizing, e.g., combinations of electron-donating dye precursors with electron-accepting compounds are disclosed in JP-B-45-14039 and JP-B-43-4160, and those utilizing diazo compounds are disclosed in U.S. Pat. No. 4,650,740, and so on.

In recent years, these image recording materials have come to be used in various areas of recording, such as facsimile, printers, labels, etc., in addition to photographic applications, so they have enjoyed an increasing need. However, because of their susceptibility to light and heat, they have a substantial defect in that they generate light fog and heat fog when exposed to ordinary room light, sunlight or white light even after the formation of images therein. Therefore, it is difficult to handle image-forming materials of the foregoing kind.

In order to retain the images which have been formed, post-development of colors which render the images obscure during storage must be avoided.

In the image-forming systems, it has already been known that primary images can be retained by applying a solution comprising a reducing agent, such as a free-radical trapping substance (e.g., hydroquinone), to materials, which have finished image formation, using a spraying or dip coating technique. This procedure, although advantageous for preserving or fixing the primary images, brings about an inevitable decrease in workability and operation facility, because it involves a wet process. On the other hand, materials which can be processed only by light alone, that is to say, images are formed by UV irradiation and fixed through the activation of photoreducing substances by exposure to visible light, as embodied in Dylux made by Du Pont, are on the market today. In this process, however, the material is in a sole possession of the apparatus during the light exposure performed twice, which entails work such as replacement of spectral filters. Accordingly, insufficient processing speed occurs in some uses. In addition, JP-B-43-29407 describes that thermal fixation after imagewise exposure is effected by incorporating a reductive thermo-fixing agent in a binder solution together with a leuco dye and a photo-oxidizing agent, or by providing the last coat of a thermo-fixing agent on a light-sensitive layer. However, this system undergoes deterioration in sensitivity over time because the fixing agent is present in the neighborhood of the light-sensitive components (a leuco dye and a photo-oxidizing agent). Therefore, such a system is also undesirable.

In producing the foregoing image-forming materials, in general, ingredients including at least a leuco dye and a photo-oxidizing agent are homogeneously dissolved in a volatile organic solvent, and the resulting solution is coated or spread out on a support, such as paper, a plastic film, etc., or a support is dipped in the resulting solution, and then the solvent is evaporated to removal by drying. Under these circumstances, it is necessary to take effective measures to prevent the manufacturing equipment from being exposed to such a volatile organic solvent as described above. Accordingly, the image-forming materials of the above-described kinds have disadvantages in terms of both safety and cost.

In heat-sensitive recording systems, on the other hand, recording methods utilizing a color-producing reaction through the coupling of a diazo compound with a coupler and a photo-decomposibility to ensure fixability are disclosed [e.g., in JP-A-57-123086 (the term "JP-A" as used herein means an "unexamined published Japanese patent application"), U.S. Pat. No. 4,400,456, JP-A-57-142636 and JP-A-57-192944]. Therein, however, fog and the like tend to occur upon storage prior to recording because reactive components (including a diazo compound, a coupler, a base, etc.) are incorporated in the same layer. Therefore, the results obtained by such methods are not wholly satisfactory. Moreover, heat-sensitive recording materials containing one of the foregoing reactive components in a microencapsulated condition are disclosed, e.g., in JP-A-59-190886, etc., which indeed show excellent image-keeping quality and high fixability, but they do not necessarily possess sufficient keeping quality before the recording processing since the diazo compound is used. Therefore, it is desired that more stable substances should be selected for not only the diazo compound but also the coupler, the base, etc.

SUMMARY OF THE INVENTION

One object of the present invention is to provide an image-forming material which is excellent in image reproducibility, freshness keeping quality and image keeping quality (fixability), and has high sensitivity and high transparency, and to provide a simple recording method using the image-forming material in which image formation and fixation processes are carried out in a completely dry condition.

Another object of the present invention is to provide an image-forming material which hardly or never requires treatment with organic solvent systems which are at a disadvantage in aptitude for manufacturing.

The above-described objects of the present invention are attained with an image-forming material comprising: (a) microcapsules, in which at least one leuco dye capable of developing a color by oxidation and at least one photo-oxidizing agent are enclosed together, and (b) at least one reducing agent not enclosed in the microcapsules.

The present invention also provides a method of recording images which comprises: (1) forming images in the image-forming material by exposure to light and (2) bringing the reducing agent into contact with the photo-oxidizing agent and a method of recording images which comprises: (1) forming latent images in the image-forming material by heating and (2) subjecting the resulting material to overall exposure.

DETAILED DESCRIPTION OF THE INVENTION

The most characteristic point in the image-forming material of the present invention consists in using microcapsules. More specifically, the microcapsules basically have the following functions:

(1) One component can be microscopically isolated from another component by placing them inside and outside the microcapsule, respectively.

(2) The influence of external circumstances (especially moisture, oxygen and preservation temperature) is reduced to the utmost by enclosing a substance inside the microcapsule, which enables stable preservation of the enclosed substance.

(3) An enclosed substance can be taken out of the microcapsule or an additive can be introduced into the microcapsule by applying external stimulation (e.g., heat, pressure, etc.) as the case demands, and thereby reaction between the components present inside and outside the microcapsule becomes feasible.

(4) Even when a core substance of the microcapsules is an organic solvent system, such as an oil, the microcapsule-dispersed system as a whole can be treated as an aqueous system.

The present invention utilizes the above-described functions (1) and (2) for the purpose of enhancing the stability of the system, the above-described functions (1) and (3) as a tool in a simple recording method involving optical exposure and subsequent thermal fixation, and the above-described function (4) as a means for improving the ability for manufacturing.

Capsules of the kind which, at ordinary temperatures, inhibit contact between substances present inside and outside the capsules through the isolation function of the capsule walls, and that lower their permeability barrier to the substances only when they are heated up to above certain temperatures, are preferred in the present invention. A permeation starting temperature in this phenomenon can be arbitrarily controlled by properly choosing a capsule wall material, a capsule core material and additives. In this case, the permeation starting temperature corresponds to the glass transition temperature of the capsule wall (as described, e.g., in U.S. Pat. No. 4,529,681, JP-A-59-190886 and JP-A-60-242094, etc.).

In order to control the glass transition temperature inherent in the capsule wall, it is necessary to variously change the kinds of capsule wall-forming materials to be used. As examples of wall materials of microcapsules which can be used, mention may be made of polyurethane, polyurea, polyester, polycarbonate, urea-formaldehyde resin, melamine-formaldehyde resin, polystyrene, styrene-methacrylate copolymer, gelatin, polyvinyl pyrrolidone, polyvinyl alcohol, and so on. These high molecular weight substances can be used in combinations of two or more.

Among the foregoing high molecular weight substances, polyurethane, polyurea, polyamide, polyester and polycarbonate are preferred for the present invention. In particular, polyurethane and polyurea are preferred over others.

In forming microcapsules to be used in the present invention, it is desirable that the core material containing reactive substances such as a leuco dye, a photo-oxidizing agent and so on is firstly emulsified and then microencapsulated by enclosure of the oil droplets with a wall of a high molecular weight substance. Reactants for forming the high molecular weight substance can be added inside and/or outside the oil droplets Details of preferred methods of manufacturing microcapsules and microcapsules which can be preferably used in the present invention are described in U.S. Pat. Nos. 3,726,804 and 3,796,696.

For instance, in the case of using polyurethaneurea as a capsule wall material, polyisocyanate and a secondary substance to form a capsule wall by reaction therewith (e.g., polyol) are admixed with an aqueous phase or an oily liquid to be encapsulated, dispersed into water in an emulsified condition, and heated so that a macromolecule-forming reaction may be caused at the surface of the individual oil droplets which results in the formation of a microcapsule wall. When polyamine or nothing is used as the forgoing secondary substance, polyurea is produced.

Polyisocyanates and substances to react therewith, that is, polyols or polyamines, which can be used in the above-described microcapsule-wall formation, are disclosed in U.S. Pat. Nos. 3,281,383, 3,773,695 and 3,793,268, JP-B48-40347, U.S. Pat. Nos. 3,723,363 and 3,838,108, and JP-A48-84086, and such compounds can be used in the present invention also.

Suitable examples of polyisocyanates include diisocyanates such as m-phenylenediisocyanate, p-phenylenediisocyanate, 2,6-tolylenediisocyanate, 2,4-tolylenediisocyanate, naphthalene-1,4-diisocyanate, diphenylmethane-4,4'-diisocyanate, 3,3'-dimethoxy-4,4'-bi-phenyl-diisocyanate, 3,3'-dimethyldiphenylmethane-4,4'-diisocyanate, xylylene-1,4-diisocyanate, 4,4'-diphenylpropanediisocyanate, trimethylenediisocyanate, hexamethylenediisocyanate, propylene-1,2-diisocyanate, butylene-1,2-diisocyanate, cyclohexylene-1,2-diisocyanate, cyclohexylene-1,4-diisocyanate and the like; triisocyanates such as 4,4',4''-triphenylmethanetriisocyanate, toluene-2,4,6-triisocyanate and the like; tetraisocyanates such as 4,4'-dimethyldiphenylmethane-2,2,-5,5'-tetraisocyanate and the like; and isocyanate prepolymers such as an adduct of hexamethylenediisocyanate and trimethylol propane, an adduct of 2,4-tolylenediisocyanate and trimethylol propane, an adduct of xylylenediisocyanate and trimethylol propane, an adduct of tolylenediisocyanate and hexanetriol, and the like.

Examples of polyols include aliphatic and aromatic polyhydric alcohols, hydroxypolyesters, hydroxypolyalkylene ethers and so on.

Polyols described in JP-A-60-49991 can also be employed. Specific examples of such polyols include ethylene glycol, 1,3-propanediol, 1,4-butanediol, 1,5-pentanediol, 1,6-hexanediol, 1,7-heptanediol, 1,8-octanediol, propylene glycol, 2,3-dihydroxy butane, 1,2-dihydroxybutane, 1,3-dihydroxybutane, 2,2-dimethyl-1,3-propanediol, 2,4-pentanediol, 2,5-hexanediol, 3-methyl-1,5-pentanediol, 1,4-cyclohexanedimethanol, dihydroxycyclohexane, diethylene glycol, 1,2,6-trihydroxyhexane, 2-phenylpropylene glycol, 1,1,1-trimethylolpropane, hexanetriol, pentaerythritol, an adduct of pentaerythritol and ethylene oxide, an adduct of glycerine and ethylene oxide, glycerine, 1,4-di(2-hydroxyethoxy)benzene, condensates produced from aromatic polyhydric alcohols and alkylene oxides, such as resorcinol dihydroxyethyl ether, etc., p-xylyleneglycol, m-xylyleneglycol, $\alpha\alpha'$-dihydroxy-p-diisopropylbenzene, 4,4'-dihydroxy-diphenylmethane, 2-(p,p'-dihydroxydiphenyl-methyl)benzyl alcohol, an adduct of bisphenol A and ethylene oxide, an adduct of bisphenol A and propylene oxide, and so on. It is desirable that polyol should be used in an amount of 0.02 to 2 moles, based on hydroxyl groups per 1 mole of isocyanate groups.

Specific examples of polyamines include ethylenediamine, trimethylenediamine, tetramethylenediamine, pentamethylenediamine, hexamethylenediamine, p-phenylenediamine, m-phenylenediamine, piperazine, 2-methylpiperazine, 2,5-dimethylpiperazine, 2-hydroxytrimethylenediamine, diethylenetriamine, triethylenetriamine, triethylenetetramine, diethylaminopropylamine, tetraethylenepentamine, amine adducts of epoxy compounds, and so on.

Polyisocyanates can produce high molecular weight compounds by reacting with water.

In general an organic solvent for forming the foregoing oil droplets can be selected properly from high boiling point oils. For example, phosphoric acid esters, phthalic acid esters, acrylic acid esters, methacrylic acid esters and other carboxylic acid esters, fatty acid amides, alkylated biphenyl, alkylated terphenyl, chlorinated paraffin, alkylated naphthalene, diarylethane, and so on can be employed as a high boiling point oil. More specifically, those described in JP-A-60-242094 and JP-A-63-45084 can be used.

To the above-described organic solvent in the present invention can further be added an auxiliary solvent as a dissolution assistant of a low boiling point. Examples of auxiliary solvents which can be particularly preferably used include ethyl acetate, isopropyl acetate, butyl acetate and methylene chloride A water-soluble high molecular weight compound which can be contained as a protective colloid in the aqueous phase to be mixed with the oily phase can be selected properly from known anionic, nonionic and amphoteric surface active agents, but preferably include polyvinyl alcohol, gelatin and cellulose derivatives.

As for the surface active agent to be contained in the aqueous phase, one which meets such a requirement that it does not undergo precipitation or agglutination by acting on the foregoing protective colloids can be selected properly from anionic or nonionic surface active agents. Suitable examples of such surface active agents include sodium alkylbenzenesulfonates (e.g., sodium laurylsulfonate), sodium dioctylsulfosuccinate, polyalkylene glycols (e.g., polyoxyethylene nonyl phenyl ether), and so on.

From the standpoints of improvements in resolution of images, and in keeping quality and handling facility of microcapsules, it is to be desired in the present invention that the size of the microcapsules should be about 20 microns or less, especially about 4 microns or less, based on the volume average particule size determined by the method described, e.g., in U.S. Pat. No. 4,598,035. When microcapsules are too small in size, there is a possibility that they will be swallowed up in holes or fibers of the substrate used. Therefore, the lower limit of the microcapsule size, although it cannot be absolutely set because of the dependence on properties of the substrate or the support used, is preferably about 0.1 micron or above.

The leuco dyes which constitute on constituent of the image forming material of the present invention will now be described in detail below.

The term leuco dyes as used in the present invention is intended to include reductive dyes of the kind which contain one or two hydrogen atoms, and form dyes developing their colors by removal of the hydrogen atom(s) or, in some cases, addition of one more electron. Since the leuco dyes of the above-described kind are colorless in a substantial sense, or lightly colored in some cases, they become a means of forming patterns when oxidized to develop their colors. This oxidation is achieved in the present invention by the co-presence of at least one photo-oxidizing agent. The photo-oxidizing agent is activated by irradiation with light to be split up into free radicals The part wherein these free radicals come into contact with leuco dyes of the foregoing kind to form a colored image is raised relative to the uncontacted part (background).

Leuco dyes which can easily develop their colors by oxidation according to the above-described mechanism include those described, e.g., in U.S. Pat. No. 3,445,234. Suitable examples of such leuco dyes are cited below for reference.

(a) Aminotriarylmethanes.
(b) Aminoxanthenes.
(c) Aminothioxanthenes.
(d) Amino-9,10-dihydroacridines.
(e) Aminophenoxazines.
(f) Aminophenothiazines.
(g) Aminodihydrophenazines.
(h) Aminodiphenylmethanes.
(i) Leuco indamines.
(j) Aminohydrocinnamic acids (cyanoethane, leucomethine).
(k) Hydrazines.
(l) Leuco indigoide dyes.
(m) Amino-2,3-dihydroanthraquinones.
(n) Tetrahalo-p,p'-biphenols.
(o) 2-(p-Hydroxyphenyl)-4,5-diphenylimidazoles.
(p) Phenethylanilines.

Among these leuco dyes, those from (a) to (i) become dyes by losing one hydrogen atom to develop their colors, while those from (j) to (p) produce parent dyes by losing two hydrogen atoms. In particular, aminotriarylmethanes are preferred over others. Generally preferred types of aminotriarylmethanes are those which contain as at least two aryl groups (a) phenyl groups substituted by $-NR_1R_2$ in the p-position to the methane carbon, wherein $R_1$ and $R_2$ each represents a hydrogen atom, an alkyl group containing 1 to 10 carbon atoms, a 2-hydroxyethyl group, a 2-cyanoethyl group or a benzyl group, or (b) phenyl groups substituted by a lower alkyl group containing 1 to 4 carbon atoms, a lower alkoxy group containing 1 to 4 carbon atoms, a fluorine atom, a chlorine atom or a bromine atom in the o-position to the methane carbon; and may contain as the third aryl group the same phenyl group as the former two groups, or a different aryl group, with specific examples including (a) a phenyl group which may be substituted by a lower alkyl group, a lower alkoxy group, a chlorine atom, a diphenylamino group, a cyano group, a nitro group, a hydroxy group, a fluorine atom, a bromine atom, an alkylthio group, an arylthio group, a thioester group, an alkylsulfone group, an arylsulfone group, a sulfonic acid group, a sulfonamido group, an alkylamido group, an arylamido group or so on, (b) a naphthyl group which may be substituted by an amino group, an amino group substituted by two lower alkyl groups, or an alkylamino group, (c) a pyridyl group which may be substituted by an alkyl group, (d) a quinolyl group, or (e) an indolinylidenyl group which may be substituted by an alkyl group. The aminotriarylmethanes as described above may assume the form of an acid salt. More preferred ones are aminotriarylmethanes in which both $R_1$ and R2 are a hydrogen atom or an alkyl group containing 1 to 4 carbon atoms, and the most preferred ones are aminotriarylmethanes whose three aryl groups are all the same.

In some cases, the triarylmethanes having the foregoing structures or other leuco dyes undergo such a color-producing dark reaction as to cause fog or coloration when applied to a photographic film, paper or other systems as an image-forming material.

However, the use of these leuco dyes becomes feasible in the novel material of the present invention through the microencapsulation of such dyes. This is because the microcapsules can hinder the color-forming dark reaction by producing the same effect as those brought about by the preservation of such a color-forming composition in the absence of air.

On the other hand, preferred photo-oxidizing agents which can be used for the image-forming material of the present invention are innactive before they are exposed to active radiation such as visible rays, ultraviolet rays, infrared rays, X-rays or so on. Every photo-oxidizing agent has different spectral sensitivities over the whole region of the spectrum, depending on its chemical structure. Consequently, a particular photo-oxidizing agent should be chosen depending on the characteristics of active rays to be used. The photo-oxidizing agent can produce an oxidizing agent capable of oxidizing a color developing agent to convert into its colored form only when exposed to such radiation.

Representative photo-oxidizing agents include halogenated hydrocarbons such as carbon tetrabromide, N-bromosuccinimide, tribromomethylphenylsulfone, etc., as described in U.S. Pat. Nos. 3,042,515 and 3,502,476; azide polymers described on page 55 of the summary reports of the lecture presented at the spring meeting of Nippon Shashin Gakkai held in 1968; azide compounds such as 2-azidobenzoxazole, benzoylazide, 2-azidobenzimidazole, etc., as described in U.S. Pat. No. 3,282,693; compounds such as 3'-ethyl-1-methoxy-2-pyridothiacyanine perchlorate, 1-methoxy-2-methylpyridinium p-toluenesulfonate, etc., as described in U.S. Pat. No. 3,615,568; lophine dimer compounds such as 2,4,5-triarylimidazole dimers, as described in JP-B-62-39728; compounds such as benzophenones, p-aminophenyl ketones, polynuclear quinones, thioxanthenones, etc.; and mixtures of two or more of the above-cited compounds. However, the invention should not be construed as being limited to these examples.

Among these photo-oxidizing agents, lophine dimer compounds and organic halogeno-compounds are favored over others. In particular, the combined use of these two kinds of compounds is the most suitable for the photo-oxidizing agent in the respect that it can achieve a high degree of sensitization upon color development through optical exposure.

Lophine dimer compounds are represented by the following formula. When they undergo dissociation, the dimers form their corresponding 2,4,5-triarylimidazolyl groups.

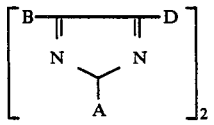

In the above formula, A, B and D may be the same or different, and each represents an aryl group which may be an unsubstituted carbon or hetero ring, or a carbon or hetero ring substituted by such group(s) so as not to inhibit the dissociation of the dimer into imidazolyl groups or the oxidation of leuco dyes.

In general the groups represented by B and D contain 0 to 3 substituent groups, while the group represented by A contains 0 to 4 substituent groups. Useful lophine dimer compounds and preparation thereof are disclosed in U.S. Pat. No. 3,522,973, from column 4, line 22 to column 6, line 3.

Organic halogeno-compounds to be used in combination with the foregoing lophine dimer compounds are solid or liquid ones containing not more than 40 carbon atoms in a molecule. Specifically, organic halogeno-compounds include (1) compounds represented by the general formula;

$R_0-CX_3$ (wherein $R_0$ is a hydrogen atom, a halogen atom or an aryl group, and X is a halogen atom), with specific examples including carbon tetrachloride, carbon tetrabromide, p-nitrobenzotribromide, bromotrichloromethane, benzotrichloride, hexabromoethane, iodoform, 1,1,1-tribromo-2-methyl-2-propanol, 1,1,2,2-tetrabromoethane, 2,2,2-tribromoethanol, 1,1,1-trichloro-2-methyl-2-propanol, etc.:

(2) compounds represented by the following general formula;

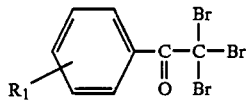

(wherein $R_1$ is a hydrogen atom or 1 to 5 substituent group on the benzene ring, which may be the same as or different from one another and selected from among nitro groups, halogen atoms, alkyl groups, haloalkyl groups, acetyl groups, haloacetyl groups and alkoxy groups), with specific examples including o-nitro-$\alpha,\alpha,\alpha$-tribromoacetophenone, m-nitro-$\alpha,\alpha,\alpha$-tribromoacetophenone, p-nitro-$\alpha,\alpha,\alpha$-tribromoacetophenone, $\alpha,\alpha,\alpha$-tribromo-3,4-dichloroacetophenone, etc.:

(3) compounds represented by the following general formula;

$R_2\text{-}SO_2\text{-}X$ (wherein $R_2$ is an unsubstituted or substituted alkyl or aryl group, and X is a halogen atom), with specific examples including 1,3-benzenedisulfonyl chloride, 2,4-dinitrobenzenesulfonyl chloride, o-nitrobenzenesulfonyl chloride, m-nitrobenzenesulfonyl chloride, 3,3'-diphenylsulfonedisulfonyl chloride, ethanesulfonyl chloride, p-bromobenzenesulfonyl chloride, p-nitrobenzenesulfonyl chloride, p-iodobenzenesulfonyl chloride, p-acetoamidobenzenesulfonyl chloride, p-chlorobenzenesulfonyl chloride, p-toluenesulfonyl chloride, methanesulfonyl chloride, benzenesulfonyl bromide, etc.: (4) compounds represented by the following general formula;

$R_3$-S-X (wherein R3 is an unsubstituted or substituted alkyl or aryl group, and X is a halogen atom), with specific examples including 2,4-dinitrobenzenesulfonyl chloride, o-nitrobenzenesulfonyl chloride, etc.: (5) compounds represented by the following general formulae;

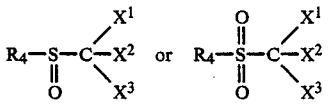

(wherein $R_4$ is an unsubstituted or substituted aryl or heterocyclic group, and $X^1$, $X^2$ and $X^3$ each is a hydrogen or halogen atom, provided that the case $X^1=X^2=X^3=H$ is excluded), with specific examples including hexabromodimethyl sulfoxide, pentabromodimethyl sulfoxide, hexabromodimethyl sulfone, trichloromethylphenyl sulfone, tribromomethylphenyl sulfone, trichloromethyl-p-chlorophenyl sulfone, tribromomethyl-p-nitrophenyl sulfone, 2-trichloromethylbenzothiazole sulfone, 4,6-dimethyl-pyrimidine-2-tribromomethyl sulfone, tetrabromodimethyl sulfone, 2,4-dichlorophenyl-trichloromethyl sulfone, 2-methyl-4-chlorophenyl-trichloromethyl sulfone, 2,5-dimethyl-4-chlorophenyltrichloromethyl sulfone, 2,4-dichlorophenyl-tribromomethyl sulfone, etc.: (6) compounds represented by the following general formula;

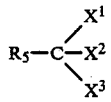

(wherein $R_5$ is an unsubstituted or substituted heterocyclic group, and $X^1$, $X^2$ and $X^3$ each is a hydrogen or halogen atom, provided that the case $X^1=X^2=X^3=H$ is excluded), with specific examples including tribromoquinaldine, 2-tri-bromomethyl-4-methylquinoline, 4-tribromomethylpyrimi-dine, 4-phenyl-6-tribromomethylpyrimidine, 2-trichloro-methyl-6-nitrobenzothiazole, 1-phenyl-3-trichloromethylpyrazole, 2,5-ditribromomethyl-3,4-dibromothiophene, 2-trichloromethyl-5-(p-butoxystyryl)-1,3,4-oxadiazole, 2,6-ditrichloromethyl-4-(p-methoxyphenyl)-triazine, etc.: and so on.

Among the above-cited ones, the compounds (2), (5) and (6) in which chlorine, bromine or iodine is present as halogen are preferred over others.

In producing the image forming material of the present invention, good results can be obtained when a leuco dye and a photo-oxidizing agent are mixed in a molar ratio ranging from about 10:1 to about 1:10, more preferably from 2:1 to 1;2.

As for the ratio between the two kinds of photo-oxidizing agents, it is desirable that an organic halogenocompound should be used in an amount of from about 0.05 to about 100 moles, preferably from 0.2 to 10 moles, per 10 moles of a lophine dimer compound.

The image forming material of the present invention can provide a stable image by forming an image therein by optical exposure and then subjecting to, e.g., a thermal treatment, or by recording therein an imagewise pattern of latent image with fine exothermic bodies such as a thermal head and then subjecting to the overall exposure. More specifically, the mechanism of the fixation in the image forming material of the present invention consists, e.g., in that the contact between a photo-oxidizing agent and a reducing agent becomes feasible by a capsule wall's gaining permeability to both or either of the agents through application of, e.g., heat to result in deactivation of the oxidizing agent through the reaction with the reducing agent even when the photo-oxidizing agent is activated after the contact, and thereby color development of the leuco dye no longer occurs.

Such a reducing agent as described above functions typically as a so-called free-radical trapping substance, or a substance capable of trapping free radicals of an activated photo-oxidizing agent. All known free-radical trapping substances can be used, with specific examples including organic reducing agents of the type which have a benzene ring substituted by not only one hydroxyl group but also another hydroxyl group or an amino group at different positions on the ring, as described in U.S. Pat. No. 3,042,515 (such as hydroquinone, catechol, resorcinol, hydroxyhydroquinone, pyrrologlycinol, o-aminophenol, p-aminophenol and other aminophenols); and cyclic phenylhydrazide compounds described in JP-B-62-39728, with specific examples including 1-phenylpyrazolidine-3-one (phenidone A, illustrated by the following structural formula (1)), 1-phenyl-4-methylpyrazolidine-3-one (phenidone B, illustrated by the following structural formula (2)), 1-phenyl-4,4-dimethylpyrazolidine--3-one (dimezone, illustrated by the following structural formula (3)), 3-methyl-1-(p-sulfophenyl)-2-pyrazoline-5-one, 3-methyl-1-phenyl-2-pyrazoline-5-one, and the like.

(1)

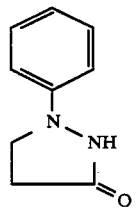

(2)

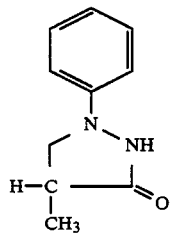

(3)

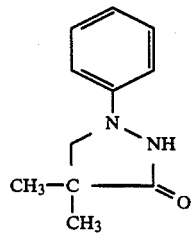

Moreover, the following substituent groups can be present on each phenyl group in the foregoing cyclic phenylhydrazides. For instance, a methyl group can be present at the o-, m- or p-position, a trifluoromethyl group at the p-position, a chlorine atom at the m- or p-position, a bromine atom at the m- or p-position, a fluorine atom at the p-position, a methoxy group at the o-, m- or p-position, an ethoxy group at the p-position, a benzyloxy group at the p-position, a butoxy group at the p-position, a phenoxy group at the p-position, three methyl groups at the 2-, 4- and 6-positions respectively, or two methyl groups at the 3- and 4-positions respectively. On the other hand, substituent group(s), such as bis-hydroxymethyl, hydroxymethyl and methyl, hydroxymethyl, dimethyl, dibutyl, ethyl, or benzyl, can be substituted for hydrogen(s) present at the 4-position of the heterocyclic group in the above-illustrated cyclic phenylhydrazides. In addition, two methyl groups, one methyl group, or one phenyl group can be substituted for hydrogen(s) present at the 5-position of the heterocyclic group in the cyclic phenylhydrazides.

Also, a compound selected from among guanidine derivatives, alkylenediamine derivatives and hydroxyamine derivatives can be employed as the reducing agent. As suitable examples of guanidine derivatives, mention may be made of phenylguanidine, 1,3-diphenylguanidine, 1,2,3-triphenylguanidine, 1,2-dicyclohexylguanidine, 1,2,3-tricyclohexylguanidine, 1,3-di-o-tolylguanidine, o-tolyldiphenylguanidine, m-tolyldiphenylguanidine, p-tolyldiphenylguanidine, N,N'-dicyclohexyl-4-morpholinocarboxyamidine, 1,3-ditolyl-3-phenylguanidine, 1,2-dicyclohexylphenylguanidine, 1-o-tolylbiguanide, N-benzylidene-guanidinoamine, and so on.

As suitable examples of alkylenediamine derivatives, mention may be made of ethylenediamine, propylenediamine tetramethylenediamine, hexamethylenediamine, octamethylenediamine, 1,1,2-diaminododecane, tetrabenzylethylenediamine, and so on.

As suitable examples of hydroxyamine derivatives, mention may be made of diethanolamine, triethanolamine, 3-$\beta$-naphthyloxy-1-N,N-dimethylamino-2-propanol, and so on.

The above-cited reducing agents, which act as free-radical trapping substances, can be used alone, or as a mixture of two or more thereof. Reducing agents to be used in the present invention should not be construed as being limited to the above-cited ones, but any reductive substance may be used, provided that it can exert an action on an oxidizing agent.

In the image forming material of the present invention, the foregoing leuco dyes and photo-oxidizing agents are enclosed together in microcapsules. On the other hand, the foregoing reducing agents are not enclosed therein, but preferably dispersed in a solid condition using a sand mill or the like, or dissolved in an oil and then dispersed in the form of emulsion.

In the case of solid dispersion, a reducing agent is dispersed in an about 2 to about 30 wt% solution of a water-soluble high molecular weight compound, and a preferable size of the dispersed particles is below 10 microns. Preferred examples of water-soluble high molecular weight compounds include those used in making microcapsules. The emulsified dispersion can be effected by reference to the methods and materials described in JP-A-63-45084.

More specifically, an oily phase containing a reducing agent and an aqueous phase containing a protective colloid and a surface active agent are mixed and dispersed using a general means for fine grained emulsification, such as high-speed agitation, ultrasonic dispersion, etc. Organic solvents and auxiliary solvents for forming oil droplets, and protective colloids and surface active agents to be admixed with an aqueous phase at the time of emulsification include the same ones as employed at the time of the microencapsulation described hereinbefore, respectively. By using the reducing agent in the form of an emulsified dispersion as described above, a recording layer excellent in transparency can be obtained.

A suitable amount of the reducing agent to be used ranges from about 1 to about 100 times by mole that of the photo-oxidizing agent used. In order to achieve the desired result using the reducing agent in the least possible amount, however, a range from 1 to 10 times is more preferred.

In the present invention, known sensitizers can be used as an additive component of the photo-oxidizing agent. For instance, the compounds described in Katsumi Tokumaru & Makoto Ohgawara, *Zohkanzai* (which means "Sensitizers"), pp. 64–75, Kohdansha (1987) can be cited. More specifically, carbonyl compounds such as aromatic ketones, acetophenones, diketones, acyloxime esters, etc., sulfur compounds such as aromatic thiols, mono- and disulfides, thioureas, dithiocarbamates, etc., organic peroxides such as benzoyl peroxide, etc., azo compounds such as azobisisobutylonitrile, etc., and halides such as N-bromosuccinimide, etc., can be used. As for the sensitizing dyes for extending the sensitivities toward the visible region, dyes having chromophores of the amidinium ion type, carboxyl ion type or bipolar amide type, as described in the above-cited book on pages 106 to 123 can be mentioned. More specifically, cyanine dyes, phthalein dyes and oxonol dyes are representative of such sensitizing dyes.

Stabilizers such as known antioxidants can be further incorporated inside the microcapsules. Since the stabilizers as used herein, although different in intended use, naturally have a function analogous to that of the above-described reducing agent, it is necessary to confine their addition amount to a minimum. Accordingly, specific examples of usable stabilizers include not only the above-illustrated free radical trapping substances, but also the compounds described in U.S. Pat. No. 4,066,459 and 2,4-dihydroxyaldoximes described in JP-A-55-55335, and these stabilizers are used in a proportion of about 0.01 mol% to about 25 mol%, particularly 0.1 mol% to 10 mol%, to the photo-oxidizing agent.

The image forming material of the present invention can be produced by coating on a support a dispersion of microcapsules, in which a leuco dye and a photo-oxidizing agent as described above are enclosed together, and a reducing agent as described above, or impregnating a support with the above-described dispersion, or making a self-support layer from said dispersion.

As a binder which can be added to the foregoing dispersion, various kinds of emulsions such as a polyvinyl alcohol emulsion, a methyl cellulose emulsion, a carboxymethyl cellulose emulsion, a hydroxypropyl cellulose emulsion, a gum arabic emulsion, a gelatin emulsion, a polyvinyl pyrrolidone emulsion, a casein emulsion, a styrene-butadiene latex, an acrylonitrile-butadiene latex, a polyvinyl acetate emulsion, a polyacrylate emulsion, an ethylene-vinyl acetate copolymer emulsion, and so on can be mentioned. Such an emulsion is used at a coverage of about 0.5 to about 5 g/m$^2$ on a solids basis.

A preferred coverage of the image forming material of the present invention ranges preferably from about 3 to about 30 g/m$^2$, particularly from 5 to 20 g/m$^2$, on a solids basis. When the coverage is below about 3 g/m$^2$, the material cannot achieve a satisfactory density, whereas when it is increased beyond about 30 g/m$^2$, so far from bringing about any improvement in image quality, the increased coverage causes a disadvantage in cost.

Suitable materials for a support include papers from tissue paper to thick bowl paper; films of plastics and polymeric substances, such as regenerated cellulose, cellulose acetate, cellulose nitrate, polyethylene terephthalate, vinyl homo- and co-polymers, polyethylene, polyvinyl acetate, polymethylmethacrylate, polyvinyl chloride, etc.; woven fabric; an materials generally used for graphic arts and decoration use, such as glass, wood and metal.

In coating the dispersion on a support, generally well-known coating methods, e.g., a dip coating method, an air knife coating method, a curtain coating method, a roller coating method, a doctor coating method, a wire-bar coating method, a slide coating method, a gravure coating method, a spin coating method, an extrusion coating method utilizing a hopper as described in U.S. Pat. No. 2,681,294, and so on can be adopted.

In order to prevent a drop in apparent transparency from occurring due to light scattering at the surface of an image forming layer, and to prevent adhesion between the image forming layer and a heating roller or the like from occurring upon thermal fixation, and to prevent adhesion among recording materials from occurring when they are superposed upon one after another, a protective layer can be provided on the image forming layer in the present invention.

As for the binder of the protective layer, water-soluble polymers are mainly used.

Specific examples of such polymers include water-soluble ones such as methyl cellulose, carboxymethyl cellulose, hydroxymethyl cellulose, starches, gelatin, gum arabic, casein, hydrolysis products of styrene-maleic anhydride copolymers, hydrolysis products of styrene-maleic anhydride copolymer half esters, polyvinyl alcohol, carboxy-denatured polyvinyl alcohol, silicon-denatured polyvinyl alcohol, polyacrylamide derivatives, polyvinyl pyrrolidone, sodium polystyrenesulfonate, sodium aliginate, etc.; and water-insoluble polymers such as styrene-butadiene rubber latex, acrylonitrile-butadiene rubber latex, methylacrylate-butadiene rubber latex, polyvinyl acetate emulsion, etc.

Also, water-insoluble binders such as silicone resins, melamine resins, phenol resins, acryl resins, polyester resins, epoxy resins, fluorine-containing resins, nitrocellulose, cellulose acetate propionate, cellulose acetate butyrate, cellulose acetate, vinylidene fluoride resins, chlorinated rubbers and so on may be used in the protective layer.

To the protective layer can be added as a filler inorganic pigments, such as zinc oxide, calcium carbonate, barium sulfate, titanium oxide, lithopone, talc, agalmatolite, kaolin, aluminium hydroxide, noncrystalline silica, collidal silica, etc.; organic pigments, such as polystyrene, polymethylmethacrylate, polyethylene, vinyl acetate resin, vinyl sulfate resin, vinylidene sulfate resin, styrene-methacrylate copolymer, vinylidene chloride resin, polyurea, melamine-formaldehyde condensate, etc.; metallic soap, such as zinc stearate, calcium stearate, aluminium stearate, etc.; or waxes such as paraffin wax, microcrystalline wax, carnauba wax, methylolstearoamide, polyethylene wax, silicone, etc.

These fillers may be used alone, or as a mixture of two or more thereof.

These fillers are added in a total proportion ranging generally from about 0.1 to about 300 wt%, particularly from 10 to 200 wt%, to the binder in the protective layer.

For the purpose of keeping the transparency of the protective layer, it is desirable that these fillers should have a particle size of 2 microns or less, more preferably 1 micron or less. When the particle size exceeds 2 microns, there occurs a great drop in transparency.

Two or more of protective layers may be provided, and at least the topmost layer should contain these fillers.

Also, a surface active agent is added to the coating composition for forming a protective layer in order to obtain uniform protective layers on the image forming layer. Suitable surface active agents include alkali metal salts of sulfosuccinic acids, such as sodium or ammonium di-(2-ethylhexyl)sulfosuccinate, sodium or ammonium di(n-hexyl)sulfosuccinate, etc.; fluorine-containing surface active agents, and so on.

In addition, a surface active agent and a polyelectrolyte may be contained in the protective layer for the purpose of preventing the image forming material from being charged. A preferred coverage of the protective layer ranges from about 0.2 to about 5 g/m$^2$, preferably from 1 to 3 g/m$^2$, on a solids basis.

On the other hand, a film made from a composition for the protective layer alone may be laminated on the image forming material.

Formation of latent images by heating can be performed in the present invention according to the same methods as employed in usual heat-sensitive recording, and therein an ordinary thermal head can be used.

In the overall exposure for image fixation, which is a process to succeed the heating, or the image formation by exposure to light, any convenient light source can be used for the formation of developed color images from leuco dyes through activation of photo-oxidizing agents. Although light for irradiation, may be natural or artifical, white or monochromatic, or noncoherent or coherent light, the light must have intensity high enough to achieve appropriate activation of the image forming composition.

Conventional light sources include fluorescent lamps, mercury lamps, metal-added and arc lamps, and so on. Coherent light sources include pulsed laser beams whose emission spectra are included in or overlap with the UV or visible light absorption band of the photo-oxidizing agent, e.g., nitrogen laser, xenon laser, argon ion laser, and ionized neon laser. Also, UV and near visible light-emitting cathode-ray tubes, which have been widely used in printout systems for writing image information in light-sensitive materials, are useful for the image-forming material of the present invention.

In forming images by irradiation with light, the images may be formed by writing with beams of activating light, or by exposing selected areas in the rear part of a negative, a stencil or another relatively opaque pattern to such light as described above. The negative may be a silver image formed on a cellulose acetate or polyester film, or an opaque pattern formed by making some areas undergo cohesion to create a difference in refractive index. The image formation may be carried out with a conventional diazo-print apparatus, a graphic arts exposure or electronic flash apparatus, or the projection apparatus disclosed in U.S. Pat. No. 3,661,461.

In both cases of forming images by light irradiation, and fixing latent images formed by heat application, a suitable exposure time may vary within the range of several tenths of a second to several minutes depending on the intensity and the spectral energy distribution of the light used, the distance between the image-forming material and the light source, the quality and the quantity of the composition used, and the color density required of an image to be formed.

In the case of forming images by light irradiation, the images can be fixed by bringing the reducing agent into contact with the photo-oxidizing agent after imagewise exposure. In order to bring these agents into contact with each other, various methods can be adopted.

As one example, there can be cited a heating method. According to this method, the temperature of the microcapsule wall is raised to a temperature higher than its glass transition point, and thereby the microcapsule wall is softened to permit the photo-oxidizing agent and the reducing agent to pass therethrough, resulting in mutual contact. The glass transition point of the microcapsule wall depends on the material used, so the condition of thermal treatment necessary for fixation can be properly chosen by considering the foregoing factor.

Another method consists in rupturing microcapsules by imposing a-mechanical force thereon, thereby bringing both of the agents into contact with each other. According to this method, materials having high glass transition points can also be used. The force required for the rupture, though dependent on the quality and the size of the microcapsules, can be determined with ease by those skilled in the art.

Moreover, a synergistic effect can be expected by applying heat and pressure to microcapsules at the same time.

On the other hand, it is possible to give fixability to an image-forming material, which comprises a leuco dye capable of developing its color through oxidation and a photo-oxidizing agent, by microencapsulating a reducing agent alone, or by additionally microencapsulating a reducing agent also in the embodiments of the present invention.

The image-forming material of the present invention is excellent in not only manufacturing aptitude, but also image producibility, freshness keeping quality and image keeping quality.

The present invention will now be illustrated in more detail by reference to the following examples. However, the invention should not be construed as being limited to these examples. All parts, ratios, percents, etc. therein are by weight unless otherwise indicated.

EXAMPLE 1

An image-forming material was prepared in the following manner.

| | |
|---|---|
| Leuco dye (Leuco Crystal Violet) | 1.5 parts |
| Photo-oxidizing agent (2,2'-Bis-(o-chlorophenyl)-4,4',5,5'-tetraphenylbiimidazole) | 3.0 parts |
| Methylene chloride | 12 parts |
| Tricresyl phosphate | 24 parts |
| Takenate D-110 N (75 wt % ethyl acetate solution) (trade name, produced by Takeda Chemical Industries, Ltd.) | 24 parts |

The above-described ingredients were mixed, and added to an aqueous solution composed of 63 parts of a 8 wt% water solution of polyvinyl alcohol and 100 parts of distilled water. The resulting mixture was emulsified and dispersed at 20° C. to obtain an emulsion having a mean droplet size of 1 micron. The thus obtained emulsion was stirred for 3 hours at 40° C., and then cooled to room temperature. The resulting emulsion was passed through a filter to obtain an aqueous capsule dispersion.

Separately, 150 parts of a 4 wt% aqueous solution of polyvinyl alcohol and 30 parts of 1-phenylpyrazolidine3-one (phenidone A), which was used as a reducing agent, were mixed and dispersed with a Daino Mill (trade name, produced by Willy A. Bachofen A.G.) to obtain a dispersion of phenidone A. The mean particle size of this dispersion was 3 microns.

Nine parts of the capsule solution and 6 parts of the phenidone A dispersion were mixed, and coated on art paper using a spin coating machine at a spinning speed of 150 r.p.m., followed by drying at 50° C. for 1 minute. Thus, Sample (1) was prepared.

Sample (1) was exposed to a Jet Light (2 KW ultra-high pressure mercury lamp, produced by ORC) through a line original, and reflection densities of the exposed part and the unexposed part in the visible region were measured with a Macbeth densitometer RD-918. The results obtained are shown in Table 1.

TABLE 1

| Sample No. | Reflection Density of Unexposed Part | Reflection Density of Exposed Part |
|---|---|---|
| (1) | 0.070 | 1.38 |

After the image formation, the resulting Sample (1) was passed between a pair of rolls heated to 120° C. (which was about 20° C. higher than the glass transition point of the capsule wall, which was determined by the dynamic viscoelasticity measurement) at a speed of 450 mm/min. to enhance the permeability of the capsule wall by heat, and thereby was achieved fixation (or contact between the ingredients present outside and inside the capsules). As a result, Sample (1) after the fixation did not suffer any change in image, notwithstanding the overall exposure under 5 times as much exposure as that in the imagewise exposure using the Jet Light.

Thus, the image-forming material of the present invention has excellent image reproducibility and image keeping quality (fixability).

EXAMPLES 2 AND 3

Sample (2) and Sample (3) were prepared in the same manner as in Example 1, except that 1-phenyl-4-methylpyrazolidine-3-one (phenidone B) and hydroquinone were used as the reducing agent in place of phenidone A, respectively.

These samples underwent the same evaluation tests as Sample (1) to bring about similar results to those of Sample (1).

EXAMPLE 4

Sample (4) was prepared in the same manner as in Example 1, except that 1,2,3-triphenylguanidine was used as a reducing agent in place of 1-phenylpyrazolidine-3-one, and exposed to light according to the same method as in Example 1. The resulting sample was examined for reflection density. The results obtained are shown in

TABLE 2

| Sample No. | Reflection Density of Unexposed Part | Reflection Density of Exposed Part |
|---|---|---|
| (4) | 0.068 | 1.32 |

Then, Sample (4) after the image formation was subjected to the same fixation procedure as in Example 1, followed by the same overall exposure. However, no change in image occurred in Sample (4).

EXAMPLE 5 AND 6

Sample (5) and Sample (6) were prepared in the same manner as in Example 4, except that tetrabenzylethylenediamine and 3-8-naphthyloxy-1-N,N-dimethylamino-2-propanol were used as a reducing agent in place of 1,2,3-triphenylguanidine, respectively.

These samples underwent the same evaluation tests as Sample (1) to bring about similar results to those of Sample (1).

EXAMPLE 7 TO 10

Image-forming materials were prepared in the following manner.

| | |
|---|---|
| Leuco yellow dye ((4-[N-Ethyl-N-{2-hydroxy-3-phenoxy-propyl}amino]-2-methylbenzylmalononitrile)carbanilate ester) | 1.5 parts |
| P-Toluene sulfonate | 0.6 part |
| Photo-oxidizing agent (2,2'-Bis-(o-chlorophenyl)-4,4',5,5'-tetraphenylbiimidazole) | 3.0 parts |
| Methylene chloride | 12 parts |
| Tricresyl phosphate | 24 parts |
| Takenate D-110 N | 24 parts |

The above-described ingredients were mixed, and treated in the same manner as in the preparation of Sample (1). The coated paper thus obtained was designated Sample (7).

Sample (8) was obtained in the same manner as Sample (7), except that p-dibutylaminophenyltricyanoethane (a leuco magenta dye) was used in place of the leuco yellow dye.

Sample (9) was obtained in the same manner as Sample (7), except that tris(2-methyl-4-diethylaminophenyl)methane (a leuco cyan dye) was used in place of the leuco yellow dye.

Sample (10) was obtained in the same manner as Sample (7), except that 0.3 part of the foregoing leuco magenta dye and 1.4 parts of bis-(2-methyl-4-diethylaminophenyl)(4-diethylaminophenyl)methane (a leuco green dye) were used in place of the leuco yellow dye.

The above-described samples were imagewise exposed in the same manner as in Example 1 to produce clear images of their respective developed-colors.

The results obtained are shown in Table 3.

TABLE 3

| Sample No. | Reflection Density of Unexposed Part | Reflection Density of Exposed Part |
|---|---|---|
| (7) (yellow) | 0.071 | 1.22 |
| (8) (magenta) | 0.069 | 1.38 |
| (9) (cyan) | 0.070 | 1.33 |
| (10) (black) | 0.072 | 1.84 |

Then, each sample underwent the same fixability test as in Example 1. As a result, no change was observed in any color image. That is, the image-forming material of the present invention proved to produce a clear image with a hue corresponding to the developed color of each leuco dye, and that to acquire steady image-keeping quality (fixability) with respect to any color image by a simple dry process, or heat application.

COMPARATIVE EXAMPLES 1 TO 9

Image-forming materials were prepared in the following manner.

| | |
|---|---|
| Leuco dye (Leuco Crystal Violet) | 1.5 parts |
| Photo-oxidizing agent (2,2'-bis-(o-chlorophenyl)-4,4',5,5'-tetraphenylbiimidazole) | 3.0 parts |
| Methylene chloride | 60 parts |
| Isopropyl alcohol | 8 parts |
| Cellulose acetate butyrate (butyryl content: 27%) | 10 parts |

The above-described ingredients were mixed to prepare a blend solution of organic solvent system, and coated and dried under the same condition as in the preparation of Sample (1) to obtain Sample (11).

Sample (12) was prepared in the same manner as Sample (11), except the blend solution contained additionally 0.1 part of a known antioxidant, hydroquinone (as disclosed in U.S. Pat. No. 3,042,515).

Sample (13) was prepared in the same manner as Sample (11), except the blend solution contained additionally 0.1 part of another known antioxidant, 1-phenylpyrazolidine-3-one (phenidone A).

Sample (14) was prepared in the same manner as Sample (11), except the blend solution contained additionally 0.1 part of still another known antioxidant, 2,4-dihydroxybenzaldoxime (disclosed in JP-A-55-55335).

Sample (15) was prepared in the same manner as Sample (13), except that the content of 1-phenylpyrazolidine-3-one in the blend solution was changed to 6 parts from 0.1 part, that is, the content of the antioxidant (radical trapping substance) was increased in the blend solution.

Sample (16) was prepared by further coating the same dispersion as prepared for Sample (1), except that hydroquinone was used in place of phenidone A, on the coat of Sample (12).

Sample (17) was prepared by further coating the same phenidone A dispersion as prepared for Sample (1) on the coat of Sample (13).

Sample (18) was prepared in the same manner as Sample (11), except that 6 parts of 1,2,3-triphenylguanidine was additionally present in the blend solution.

Sample (19) was prepared by further coating the same dispersion of 1,2,3-triphenylguanidine as prepared for Sample (4) on the coat of Sample (13).

The thus prepared samples (11) to (19), and the samples (1), (4), (7), (8), (9) and (10) prepared in Examples 1, 4, 7, 8, 9 and 10, respectively, underwent the following tests.

Firstly, these coated papers underwent a dark reaction accelerating test under the conditions of 45° C., 75% RH, and thereby these unexposed samples were examined for change in color with a lapse of time.

The results obtained are shown in Table 4.

TABLE 4

| Sample No. | Reflection Density after Lapse of Time Fresh | 3 Days | 7 days | 14 days | Remarks |
|---|---|---|---|---|---|
| (1) | 0.070 | 0.072 | 0.073 | 0.075 | Invention |
| (4) | 0.068 | 0.070 | 0.072 | 0.074 | " |
| (7) | 0.071 | 0.071 | 0.073 | 0.074 | " |
| (8) | 0.069 | 0.070 | 0.071 | 0.072 | " |
| (9) | 0.070 | 0.070 | 0.073 | 0.073 | " |
| (10) | 0.072 | 0.072 | 0.074 | 0.074 | " |
| (11) | 0.078 | 0.114 | 0.152 | 0.188 | Comparison |
| (12) | 0.084 | 0.102 | 0.117 | 0.132 | " |
| (13) | 0.080 | 0.088 | 0.099 | 0.108 | " |
| (14) | 0.078 | 0.085 | 0.098 | 0.105 | " |
| (15) | 0.090 | 0.091 | 0.094 | 0.096 | " |
| (16) | 0.087 | 0.090 | 0.095 | 0.096 | " |
| (17) | 0.082 | 0.083 | 0.085 | 0.090 | " |
| (18) | 0.091 | 0.093 | 0.096 | 0.099 | " |
| (19) | 0.083 | 0.085 | 0.091 | 0.097 | " |

As can be seen from thr data set forth in Table 4, the samples of the invention, (1), (4) and (7) to (10), had excellent freshness keeping quality due to microencapsulation, and showed scarcely any coloration in their respective fresh conditions, compared with comparative samples.

Further, each of the samples after a 7-day lapse (represented by the symbol (()') was imagewise exposed in the same manner as in example 1. The results obtained are shown in Table 5.

TABLE 5

| Sample No. | Reflection density in unexposed part | Reflection density in exposed part | Remarks |
|---|---|---|---|
| (1)' | 0.073 | 1.34 | Invention |
| (4)' | 0.072 | 1.34 | " |
| (7)' | 0.073 | 1.22 | " |
| (8)' | 0.071 | 1.35 | " |
| (9)' | 0.073 | 1.30 | " |
| (10)' | 0.074 | 1.82 | " |
| (11)' | 0.152 | 1.10 | Comparison |
| (12)' | 0.117 | 0.98 | " |
| (13)' | 0.099 | 1.14 | " |
| (14)' | 0.098 | 1.02 | " |
| (15)' | 0.094 | 0.098 | " |
| (16)' | 0.095 | 0.675 | " |
| (17)' | 0.085 | 0.592 | " |
| (18)' | 0.096 | 0.621 | " |
| (19)' | 0.091 | 0.587 | " |

While the samples of the present invention, (1)', (4)', and (7)' to (10)', were little colored in their respective unexposed parts (background) and had excellent image reproducibilities (developed color densities), the comparative samples, (11)' to (19)', suffered from remarkable coloring in the background or deterioration of sensitivity (sharp decrease in developed-color density) due to the lapse of time, that is, they were markedly inferior to the samples of the present invention.

Furthermore, each sample after the image formation underwent the same fixability test as in Example 1, which involved making each sample pass between heating rolls.

A change caused in the image of each sample after the second overall exposure was evaluated by visual observation. The results thereof are shown in Table 6.

TABLE 6

| Sample No. | Change in Image | Remarks |
|---|---|---|
| (1)' | No change (Keeping clear image) | Invention |
| (4)' | " | " |
| (7)' | " | " |
| (8)' | " | " |
| (9)' | " | " |

TABLE 6-continued

| Sample No. | Change in Image | Remarks |
|---|---|---|
| (10)' | " | " |
| (11)' | Overall coloring (No thermal fixability) | Comparison |
| (12)' | Overall coloring (No thermal fixability) | " |
| (13)' | Overall coloring (No thermal fixability) | " |
| (14)' | Overall coloring (No thermal fixability) | " |
| (15)' | Slight change (No coloring) | " |
| (16)' | Slight change (Low image density) | " |
| (17)' | Slight change (Low image density) | " |
| (18)' | Slight change (No coloring) | " |
| (19)' | Slight change (Low image density) | " |

It can be seen from the results of the above-described examples and comparative examples that the image-forming material of the present invention (the samples (1), (4), and (7) to (10)) have advantages in that it is excellent in freshness keeping quality, image reproducibility and image keeping quality (fixability), compared with the comparative materials (the samples (11) to (19)), and these excellent properties were realized through a completely dry and simple process, or the imagewise exposure-heating process, and it had also excellent handling facility and safety in its coating process, that is, an aptitude for manufacturing, because the coating process was effected using an aqueous system.

EXAMPLE 11

An image-forming material was prepared in the following manner.

| | |
|---|---|
| Leuco dye (Leuco Crystal Violet) | 3.0 parts |
| Photo-oxidizing agent: 2,2'-Bis-(o-chlorophenyl)-4,4',5,5'-tetraphenylbiimidazole) | 3.0 parts |
| Tribromomethylphenylsulfone | 0.6 part |
| Methylene chloride | 22 parts |
| Tricresyl phosphate | 24 parts |
| Takenate D-110 N (75 wt % ethyl acetate solution) (trade name, produced by Takeda Chemical Industries, Ltd.) | 24 parts |

The above-described ingredients were mixed, and added to an aqueous solution composed of 63 parts of a 8 wt% water solution of polyvinyl alcohol and 100 parts of distilled water. The resulting mixture was emulsified and dispersed at 20° C. to obtain an emulsion having a mean droplet size of 1 micron. The thus obtained emulsion was stirred for 3 hours at 40° C., and then cooled to room temperature. The resulting emulsion was passed through a filter to obtain an aqueous capsule dispersion.

Separately, 150 parts of a 4 wt% aqueous solution of polyvinyl alcohol and 30 parts of 1-phenylpyrazolidine3-one (phenidone A), which was used as a reducing agent, were mixed and dispersed with a Daino Mill (trade name, produced by Willy A Bachofen A. G.) to obtain a dispersion of phenidone A. A mean particle size of this dispersion was 3 microns.

Nine parts of the capsule solution and 6 parts of the phenidone A dispersion were mixed, and coated on supercalendered wood-free paper (having a basis weight of 64 g/m$^2$) at a coverage of 10 g/m$^2$ on a solids basis, followed by drying at 50° C. for 1 minute. Thus, Sample (20) was prepared.

COMPARATIVE EXAMPLES 10 AND 11

Samples (21) and (22) were prepared in the same manner as in Example 11, except 3.6 parts of 2,2'-bis-(o-chlorophenyl)-4,4,5,5'-tetraphenylbiimidazole and 0.6 part of tribromomethylphenylsulfone were used respectively as a photo-oxidizing agent in place of the combined use of these compounds.

Each of these samples was exposed to a Jet Light (2 KW ultra-high pressure mercury lamp, produced by ORC) through a line original, and reflection densities of the exposed part in the visible region were measured with a Macbeth densitometer RD-918. The results obtained are shown in Table 7.

TABLE 7

| Sample No. | Exposure | Reflection Density in Exposed Part | Remarks |
|---|---|---|---|
| (20) | 50 counts | 1.20 | Invention |
| (21) | 50 counts | 0.08 | Comparison |
| | 100 counts | 0.31 | |
| | 400 counts | 1.18 | |
| (22) | 50 counts | 0.07 | " |
| | 100 counts | 0.08 | |
| | 400 counts | 0.42 | |

As can be seen from the data set forth in Table 7, the combined use of two special kinds of photo-oxidizing agents in the present invention enabled a remarkable reduction in exposure required for attaining an intended reflection density in the exposed part through their synergistic effect, which had been quite unexpected from their respective independent uses, thereby achieving an epochal increase in sensitivity.

After the image formation, the resulting Sample (20) was passed between a pair of rolls heated to 120° C. (which was about 20° C. higher than the glass transition point of the capsule wall, which was determined by the dynamic viscoelasticity measurement) at a speed of 450 mm/min. to enhance the permeability of the capsule wall by heat, and thereby was achieved fixation (or contact between the ingredients present outside and inside the capsules). As a result, Sample (20) after the fixation did not suffer any change in image, notwithstanding the overall exposure under 5 times as much exposure as that in the imagewise exposure using the Jet Light.

EXAMPLE 12

Sample (23) was prepared in the same manner as in Example 11, except that 0.3 part of 2-trichloromethyl-5-(p-butoxystyryl)-1,3,4-oxadiazole was used as one of the photo-oxidizing agents in place of 0.6 part of tribromomethylphenylsulfone.

The sample (23) was irradiated with light emitted from a Jet Light through a line original. Therein, the exposure was 20 counts. Thus, clearly developed color image having a reflection density of 1.15 was obtained.

Then, the sample (23) after the image formation was subjected to the same fixation procedure and subsequent overall exposure as in Example 11. As a result, no change in image was observed.

EXAMPLE 13

Sample (24) was prepared in the same manner as in Example 11, except that 3.0 parts of tris-(2-methyl-4-diethylaminophenyl)-methane was used as a leuco dye in place of 3.0 parts of leuco Crystal Violet, and 3.0 parts of 2,6-ditrichloromethyl-4-(p-methoxyphenyl)-triazine was used as one of the photo-oxidizing agents in place of 0.6 part of tribromomethylphenylsulfone.

The sample (24) was irradiated with light emitted from a Jet Light through a line original. Therein, the exposure was 100 counts. Thus, clearly developed color image having a reflection density of 1.38 was obtained.

Then, the sample (24) after the image formation was subjected to the same fixation procedure and subsequent overall exposure as in Example 11. As a result, no change in image was observed.

EXAMPLE 14

An image-forming material was prepared in the following manner.

| | |
|---|---|
| Leuco dye (Leuco Crystal Violet) | 1.5 parts |
| Photo-oxidizing agent (2,2'-Bis-(o-chlorophenyl)-4,4',5,5'-tetraphenylbiimidazole) | 3.0 parts |
| Methylene chloride | 12 parts |
| Tricresyl phosphate | 24 parts |
| Takenate D-110 N (75 wt % ethyl acetate solution) (trade name, produced by Takeda Chemical Industries, Ltd.) | 24 parts |

The above-described ingredients were mixed, and added to an aqueous solution composed of 63 parts of a 8 wt% aqueous solution of polyvinyl alcohol and 100 parts of distilled water. The resulting mixture was emulsified and dispersed at 20° C. to obtain an emulsion having a mean droplet size of 1 micron. The thus obtained emulsion was stirred for 3 hours at 40° C., and then cooled to room temperature. The resulting emulsion was passed through a filter to obtain an aqueous capsule dispersion.

Separately, 42 g of phenidone A (1-phenylpyrazolidine-3-one) was dissolved in a mixture of 8 g of diethyl maleate and 30 g of ethyl acetate. The resulting solution was mixed with an aqueous solution composed of 100 g of a 8% aqueous solution of polyvinylalcohol, 150 g of water and 0.5 g of sodium dodecylbenzenesulfonate, and emulsified for 5 min. at room temperature using an Ace Homogenizer (trade name, produced by Nippon Seiki K. K.) at 10,000 r.p.m. to obtain an emulsified dispersion having a mean droplet size of 0.5 micron.

Nine parts of the capsule solution and 7 parts of the phenidone A dispersion were mixed, and coated on a 75 micron-thick polyethylene terephthalate base using a spin coating machine at a spinning speed of 150 r.p.m., followed by drying at 50° C. for 1 minute. On the thus formed coat, polyvinyl alcohol (Kuraray PVA 117) was further coated with a rod bar at a coverage of 0.5 g/m$^2$ on a solid basis. Thus, Sample (25) was prepared.

EXAMPLES 15 AND 16

Samples (26) and (27) were prepared in the same manner as in Example 14, except that 1-phenyl-4-methylpyrazolidine-3-one (phenidone B) and hydroquinone were used as reducing agents, respectively, in place of phenidone A.

COMPARATIVE EXAMPLES 12 AND 13

Image-forming materials were prepared in the following manner.

| | |
|---|---|
| Leuco dye (Leuco Crystal Violet) | 1.5 parts |
| Photo-oxidizing agent (2,2'-Bis-o-chlorophenyl)-4,4',5,5'-tetraphenylbiimidazole) | 3.0 parts |
| Methylene chloride | 60 parts |

-continued

| | |
|---|---|
| Isopropyl alcohol | 8 parts |
| Cellulose acetate butyrate (butyryl content: 27%) | 10 parts |

The above-described ingredients were mixed to prepare a blend solution of organic solvent system, and coated and dried under the same condition as in the preparation of Sample (25). Further, a protective layer was provided on this coat under the same condition as in Sample (25) to obtain Sample (28).

Sample (29) was prepared in the same manner as Sample (28), except that the blend solution contained additionally 0.1 part of a known antioxidant, hydroquinone (as disclosed in U.S. Pat. No. 3,042,515).

COMPARATIVE EXAMPLE 14

An image-forming material was prepared in the following manner.

| | |
|---|---|
| Leuco dye (Leuco Crystal Violet) | 1.5 parts |
| Photo-oxidizing agent (2,2'-Bis-o-chlorophenyl)-4,4',5,5'-tetraphenylbiimidazole) | 3.0 parts |
| Methylene chloride | 12 parts |
| Tricresyl phosphate | 24 parts |
| Takenate D-110 N (75 wt % ethyl acetate solution) (trade name, produced by Takeda Chemical Industries, Ltd.) | 24 parts |

The above-described ingredients were mixed, and added to an aqueous solution composed of 63 parts of a 8 wt% aqueous solution of polyvinyl alcohol and 100 parts of distilled water. The resulting mixture was emulsified and dispersed at 20° C. to obtain an emulsion having a mean droplet size of 1 micron. The thus obtained emulsion was stirred for 3 hours at 40° C., and then cooled to room temperature. The resulting emulsion was passed through a filter to obtain an aqueous capsule dispersion.

Separately, 150 parts of a 4 wt% aqueous solution of polyvinyl alcohol and 30 parts of 1-phenylpyrazolidine3-one (phenidone A), which was used as a reducing agent, were mixed and dispersed with a Daino Mill (trade name, produced by Willy A Bachofen A. G.) to obtain a dispersion of phenidone A. The mean particle size of this dispersion was 3 microns.

Nine parts of the capsule solution and 7 parts of the phenidone A dispersion were mixed, and coated on a 75 micron-thick polyehtylene terephthalate support using a spin coating machine at a spinning speed of 150 r.p.m., followed by drying at 50° C. for 1 minute. On the thus formed coat, a protective layer was further provided in the same manner as in Example 14. Thus, Sample (30) was prepared.

Then, each sample underwent the following test.

(Test A)

Each sample was exposed to a Jet Light (2 KW ultrahigh pressure mercury lamp, produced by ORC) through a line original, and transmission densities of the exposed part and the unexposed part in the visible region were measured with a Macbeth densitometer TD-904.

(Test B)

These samples after the image formation were each passed between a pair of rolls heated to 120° C. (which was about 20° C. higher than the glass transition point of the capsule wall, which was determined by the dynamic viscoelasticity measurement) at a speed of 450 mm/min. to heighten the permeability of the capsule wall by heat, and thereby was achieved fixation (or the contact between the ingredients present outside and inside the capsules). Thereafter, the resulting samples were subjected to overall exposure using the foregoing Jet Light under the same exposure as the imagewise exposure, and then examined for transmission density. In addition, the samples were actually projected with an overhead projector, and thereby the contrast between the image part and the background was evaluated by visual observation.

The mark "o" represents that a sample is fit for overhead projection (OHP) use, and the mark "x" represents that a sample is unfit for OHP use.

(Test C)

Each sample was allowed to stand under the conditions of 45° C. and 75% RH to undergo the dark reaction acceleration test, and thereby a change in color of the unexposed samples was followed.

The results obtained are shown in Table 8.

TABLE 8

| | | Test A Before Thermal Fixation | | Test B Exposure After Thermal Fixation | | | Test C Transmission |
|---|---|---|---|---|---|---|---|
| | | Transmission Density in Unexposed Area | Transmission Density in Exposed Area | Transmission Density in Unexposed Area* | Transmission Density in Exposed Area** | Transparency of Unexposed Area* | Density After 14-day lapse From Dark reaction acceleration Test |
| Sample (25) | [Example 14] | 0.060 | 0.70 | 0.062 | 0.70 | O | 0.063 |
| Sample (26) | [Example 15] | 0.060 | 0.71 | 0.063 | 0.71 | O | 0.062 |
| Sample (27) | [Example 16] | 0.060 | 0.70 | 0.061 | 0.70 | O | 0.061 |
| Sample (28) | [Comparative Example 12] | 0.061 | 0.72 | 0.71 | 0.70 | O | 0.12 |
| Sample (29) | [Comparative Example 13] | 0.060 | 0.71 | 0.72 | 0.71 | O | 0.11 |
| Sample (30) | [Comparative Example 14] | 0.070 | 0.72 | 0.072 | 0.72 | x | 0.075 |

Note:
The mark * means the unexposed area in Test A.
The mark ** means the exposed area in Test A.

As can be seen from the above-described results, the samples (25) to (27) had not only excellent freshness keeping quality, image reproducibility and image keeping quality (fixability), but also high transparency.

EXAMPLE 17

An image-forming material was prepared in the following manner.

| | |
|---|---|
| Leuco dye (Leuco Crystal Violet) | 3.0 parts |
| Photo-oxidizing agent: | |
| 2,2'-Bis-(o-chlorophenyl)-4,4',5,5'-tetraphenylbiimidazole | 3.0 parts |
| Tribromomethylphenylsulfone | 0.6 part |
| Auxiliary agent: | |
| 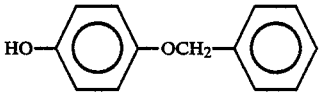 | 0.4 part |
| Methylene chloride | 22 parts |
| Tricresyl phosphate | 24 parts |
| Takenate D-110 N (75 wt % ethyl acetate solution) (trade name, produced by Takeda Chemical Industries, Ltd.) | 24 parts |

The above-described ingredients were mixed, and added to an aqueous solution composed of 63 parts of a 8 wt% aqueous solution of polyvinyl alcohol and 100 parts of distilled water. The resulting mixture was emulsified and dispersed at 20° C. to obtain an emulsion having a mean droplet size of 1 micron. The thus obtained emulsion was stirred at 40° C. for 3 hours, and then cooled to room temperature. The resulting emulsion was passed through a filter to obtain an aqueous capsule dispersion.

Separately, 150 parts of 4 wt% aqueous solution of polyvinyl alcohol and 30 parts of 1-phenylpyrazolidine-3-one (phenidone A), functioning as a reducing agent, were mixed and dispersed with a Daino Mill (trade name, produced by Willy A Bachofen A. G.) to obtain a phenidone A dispersion having a mean particle size of 3 microns.

Nine parts of the capsule dispersion and 6 parts of the phenidone A dispersion were mixed, and coated on supercalendered wood-free paper (having a basis weight of 64 g/m$^2$) at a coverage of 10 g/m$^2$ on a solids basis, followed by drying at 50° C. for 1 minute. Thus, Sample (31) was prepared.

A sheet of the sample was heated, in several randomly chosen spots, at 100° C. for 1 second using a hot block, and the resulting sample sheet was designated Sample (31-1). In addition, a test chart was recorded on another sheet of Sample (31) with a thermal head by passing the sample sheet through a facsimile, NEC Nefax 3EX (trade name, produced by NEC Corporation.). The resulting sample sheet was designated Sample (31-2).

These sample sheets were subjected to overall exposure for 5 seconds with the Jet Light to obtain developed color images. The developed and undeveloped color parts of each sample sheets were examined for reflection density in the visible region using a Macbeth densitometer RD-918. The results obtained are shown in Table 9.

TABLE 9

| | Reflection Density in Developed Color Part | Reflection Density in Undeveloped Color Part |
|---|---|---|
| Sample (31-1) | 1.38 | 0.070 |
| Sample (31-2) | 1.32 | 0.068 |

The sample sheets after the image formation were passed between a pair of rollers heated up to 100° C. at a travelling speed of 450 mm/min. As a result, no change in image was observed. That is, the completion of fixation was ascertained.

From the above-described results, Sample (31) has proved to easily produce a latent image by heating, and to fix the image by subsequent overall exposure, that is to say, to have excellent heat-sensitive recording characteristics.

While the invention has been described in detail and with reference to specific embodiments thereof, it will be apparent to one skilled in the art that various changes and modifications can be made therein without departing from the spirit and scope thereof.

What is claimed is:

1. An image-forming material consisting essentially of: (a) microcapsules, in which at least one leuco dye capable of developing a color by oxidation and at least one photo-oxidizing agent are enclosed together, and (b) at least one reducing agent no enclosed in said microcapsules, wherein the microcapsules have capsule walls made from a material which lowers its permeability barrier to at least one component selected from said photo-oxidizing agent and said reducing agent when the capsule wall material is heated above its glass transition temperature.

2. An image-forming material of claim 1, wherein said photo-oxidizing agent comprises a combination of a lophine dimer with an organic halogeno-compound.

3. An image-forming material of claim 1, wherein said reducing agent is present in such a condition that it is dissolved in an organic solvent insoluble or slightly soluble in water, and dispersed in the form of an emulsion.

4. A method of recording images, which comprises:

(1) optically exposing an image-forming material consisting essentially of: (a) microcapsules, in which at least one leuco dye capable of developing a color by oxidation and at least one photo-oxidizing agent are enclosed together, and (b) at least one reducing agent not enclosed in said microcapsules, wherein the microcapsules have capsule walls made from a material which lowers its permeability barrier to at least one component selected from said photo oxidizing agent and said reducing agent when the capsule wall material is heated above its glass transition temperature; and (2) bringing said reducing agent into contact with said photo-oxidizing agent after the optical exposure by heating the image-forming material to a temperature above said glass transition temperature.

5. A method of recording images, which comprises:

(1) forming a latent image by heating an image-forming material comprising: (a) microcapsules, in which at least one leuco dye capable of developing a color by oxidation and at least one photo-oxidizing agent are enclosed together, and (b) at least one reducing agent not enclosed in said microcapsules, wherein the microcapsules have capsule walls made from a material which lowers its permeability carrier to at least one component selected from said photo-oxidizing agent and said reducing agent when the capsule wall material is heated above its glass transition temperature, and wherein said heating is a heating to a temperature above said glass transition temperature; and (2) subjecting said material to overall exposure after the heating.

* * * * *